United States Patent [19]

Ferrari

[11] Patent Number: 4,493,587

[45] Date of Patent: Jan. 15, 1985

[54] SYSTEM FOR CREATING DAMS WITH MOBILE AND/OR PARTIALLY MOBILE WATER-RETAINING ELEMENTS

[76] Inventor: Antonio Ferrari, Via Celestino Lendri, Fumane (Verona), Italy

[21] Appl. No.: 309,744

[22] Filed: Oct. 8, 1981

[30] Foreign Application Priority Data

Feb. 18, 1981 [IT] Italy ..... 84961 A/81
Apr. 8, 1981 [IT] Italy ..... 84923 A/81

[51] Int. Cl.[3] ..... E02B 7/40
[52] U.S. Cl. ..... 405/114; 405/100; 405/110; 52/69
[58] Field of Search ..... 405/101, 107, 110, 111, 405/112, 113, 114, 224, 227, 87, 99, 100; 52/155, 69, 64

[56] References Cited

U.S. PATENT DOCUMENTS

| | | | |
|---|---|---|---|
| 1,097,916 | 5/1914 | Church | 405/110 |
| 1,628,933 | 5/1927 | Troiel | 405/114 X |
| 1,898,095 | 2/1933 | Noetzli | 405/114 X |
| 2,515,059 | 7/1950 | Rowbotham | 405/110 |
| 3,213,628 | 10/1965 | Serota | 405/111 |
| 3,509,724 | 5/1970 | Turner | 405/101 |
| 3,720,067 | 3/1973 | Aubert | 405/107 |
| 3,886,751 | 6/1975 | Porraz-Jiminez-Labora | 405/107 |
| 4,146,346 | 3/1979 | Salo | 405/100 X |
| 4,189,252 | 2/1980 | Inman | 405/111 X |
| 4,300,858 | 11/1981 | Zintz et al. | 405/100 |

*Primary Examiner*—Stephen J. Novosad
*Assistant Examiner*—Beverly E. Hjorth
*Attorney, Agent, or Firm*—Lester Horwitz

[57] ABSTRACT

Dams which basically consist of foundation plinths, secured as necessary, which plinths carry mobile and/or partially mobile dam elements, which can be inclined using lifting or lowering devices. The system also includes a control cabin.

9 Claims, 13 Drawing Figures

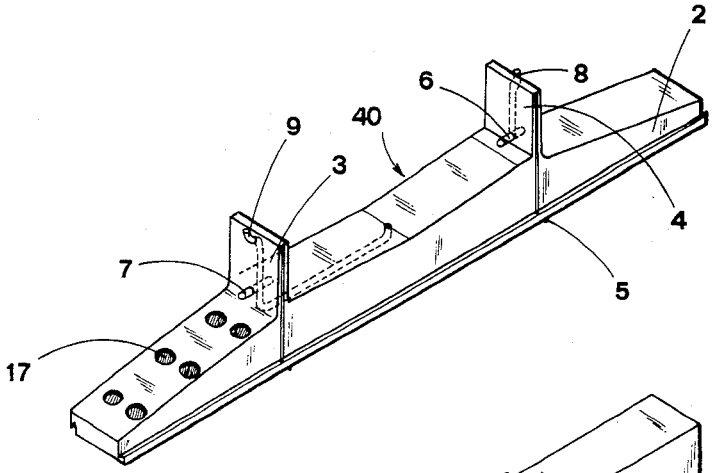
Fig. 4
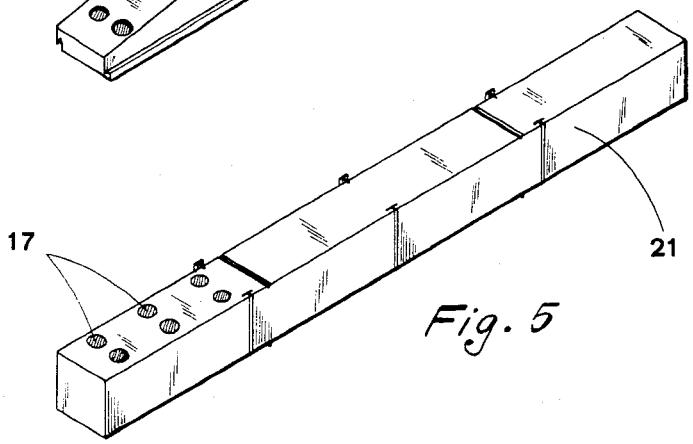
Fig. 5
Fig. 6
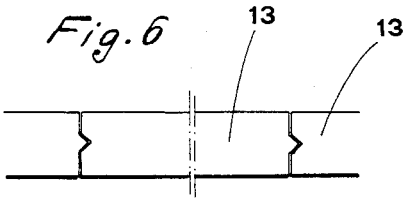
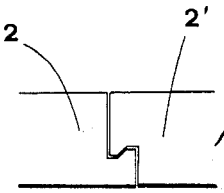
Fig. 7
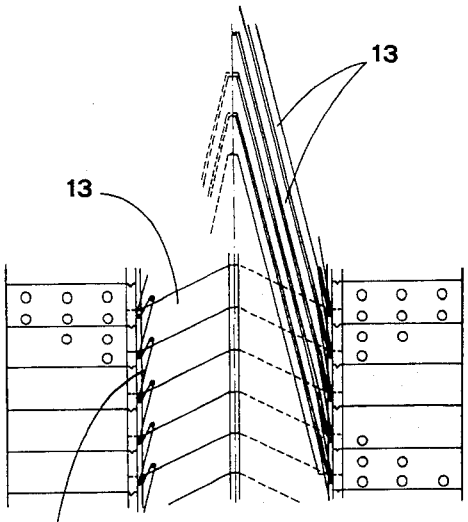
Fig. 3

SYSTEM FOR CREATING DAMS WITH MOBILE AND/OR PARTIALLY MOBILE WATER-RETAINING ELEMENTS

TEXT OF THE DESCRIPTION

The present patent of invention refers to a system for making dams using mobile and/or partially mobile water-retaining elements.

The dams in question are especially useful because of the simplicity with which they are installed: they can, in fact, be installed anywhere it is necessary to alternate periods of damming with periods of free flow and/or backflow, such as on river locks, and can also be used to make up artificial basins or other waterworks.

Another characteristic, in addition to the fact that some of its components are mobile, is that the dam, preferably made entirely out of prefabricated components, can be easily, quickly and economically installed, removed, and reinstalled in another site. The main characteristic of the invention is the fact that it has one or more foundation plinths, secured as necessary to the sea or river bottom, which plinths carry mobile or partially mobile elements, since these elements, using lifting or lowering systems, can be inclined. The control devices for these lifting and lowering systems can be situated in one or more control cabins.

The system also provides for piles for anchorage to the sea or river bottom, levelling masses, and other components for maintaining the mobile parts of said dam in efficient working order.

Figure 1:
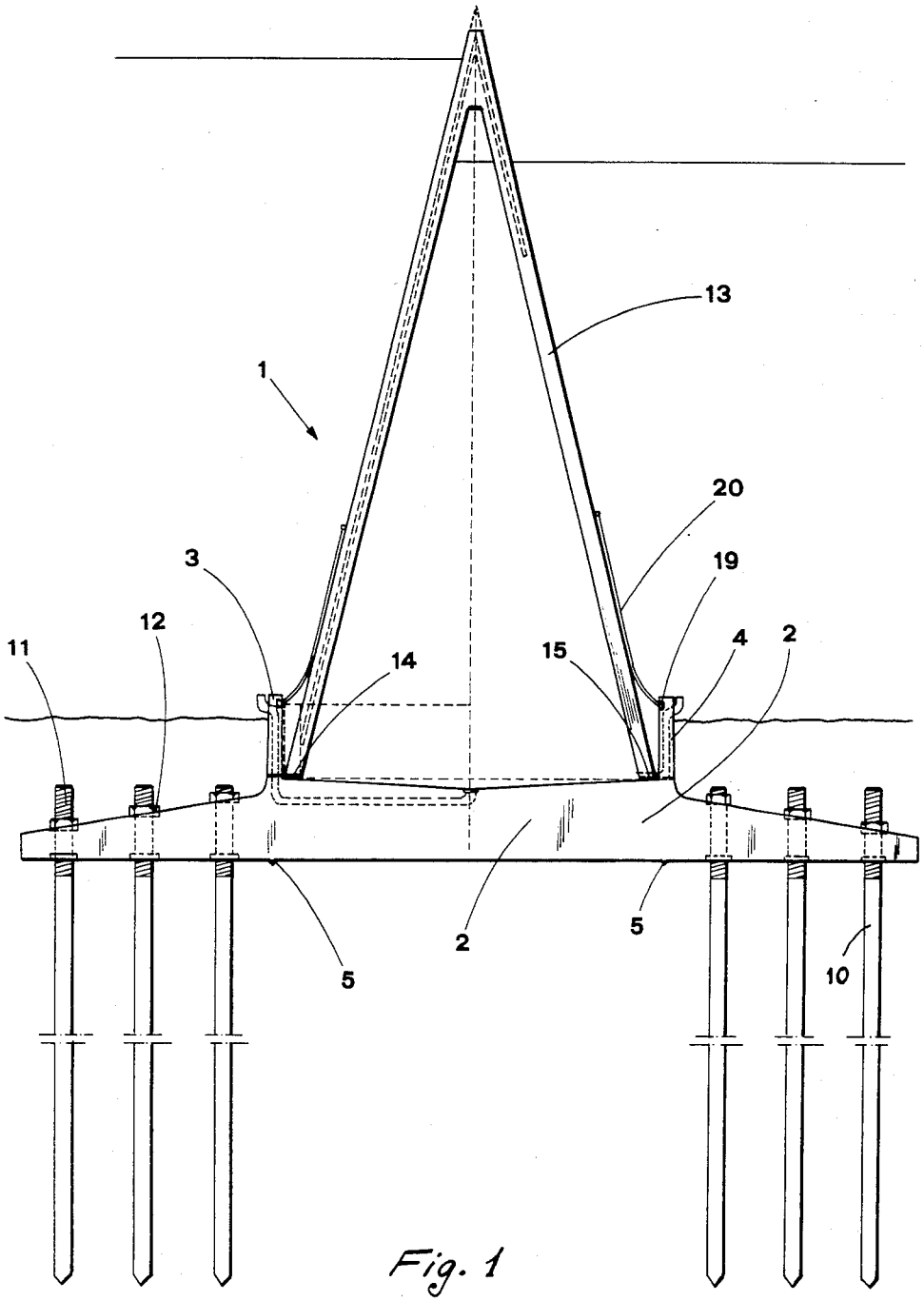

The invention shall be better understood from the description that follows, given as an example and in no way limiting any types of embodiment of the invention, as well as the enclosed drawings, including:

FIG. 1, showing a schematic cross-section of the dam with the mobile elements in their open position.

Figure 2:
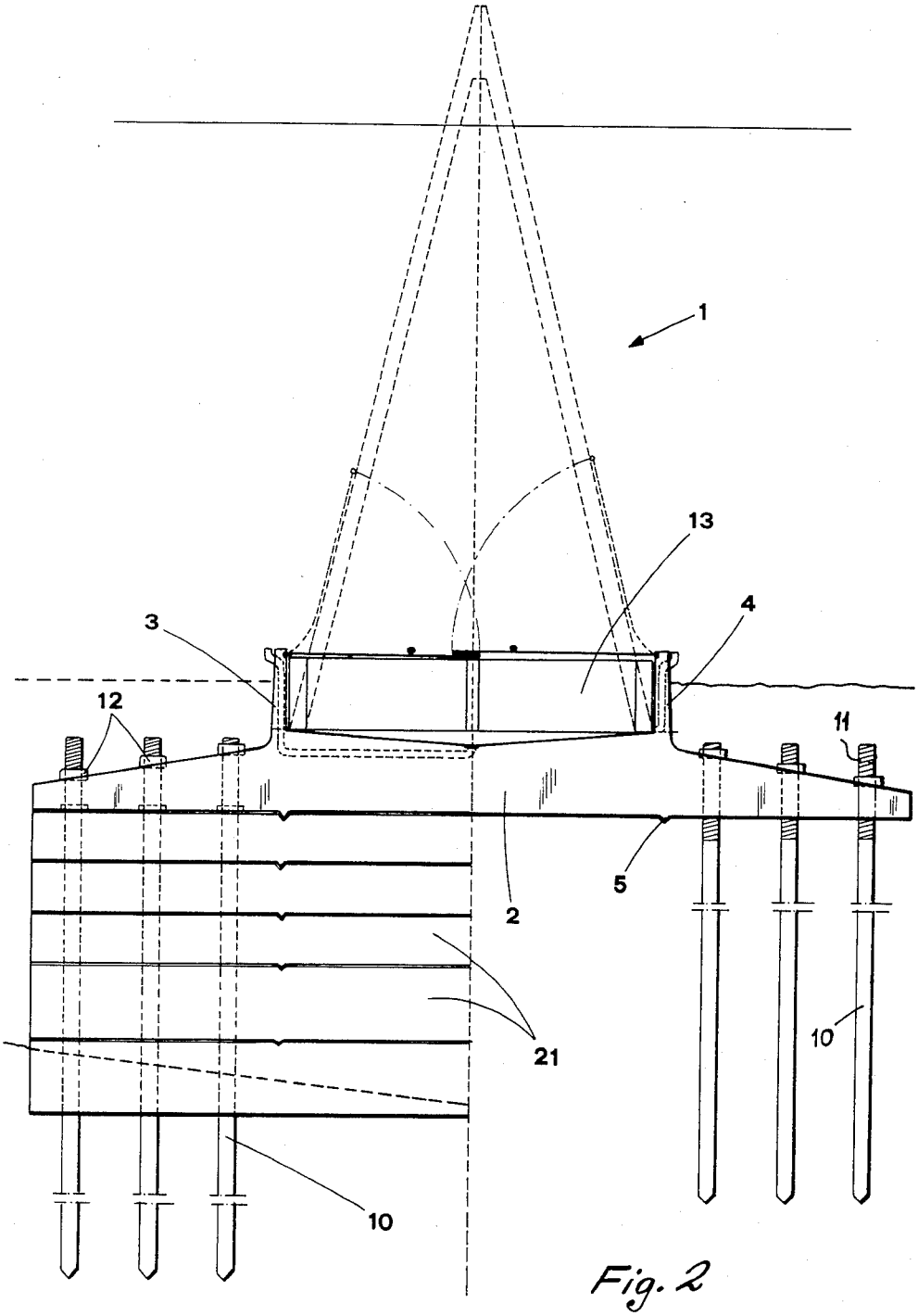

FIG. 2, showing a schematic cross-section of the dam with the mobile elements in their closed position.

FIG. 3, showing a schematic plan of the object of the invention.

FIG. 4, showing a perspective view of a foundation plinth.

FIG. 5, showing a perspective view of a levelling mass.

FIG. 6, showing a detail of mobile element connections.

FIG. 7, showing a detail of foundation plinth connections.

Figure 8:
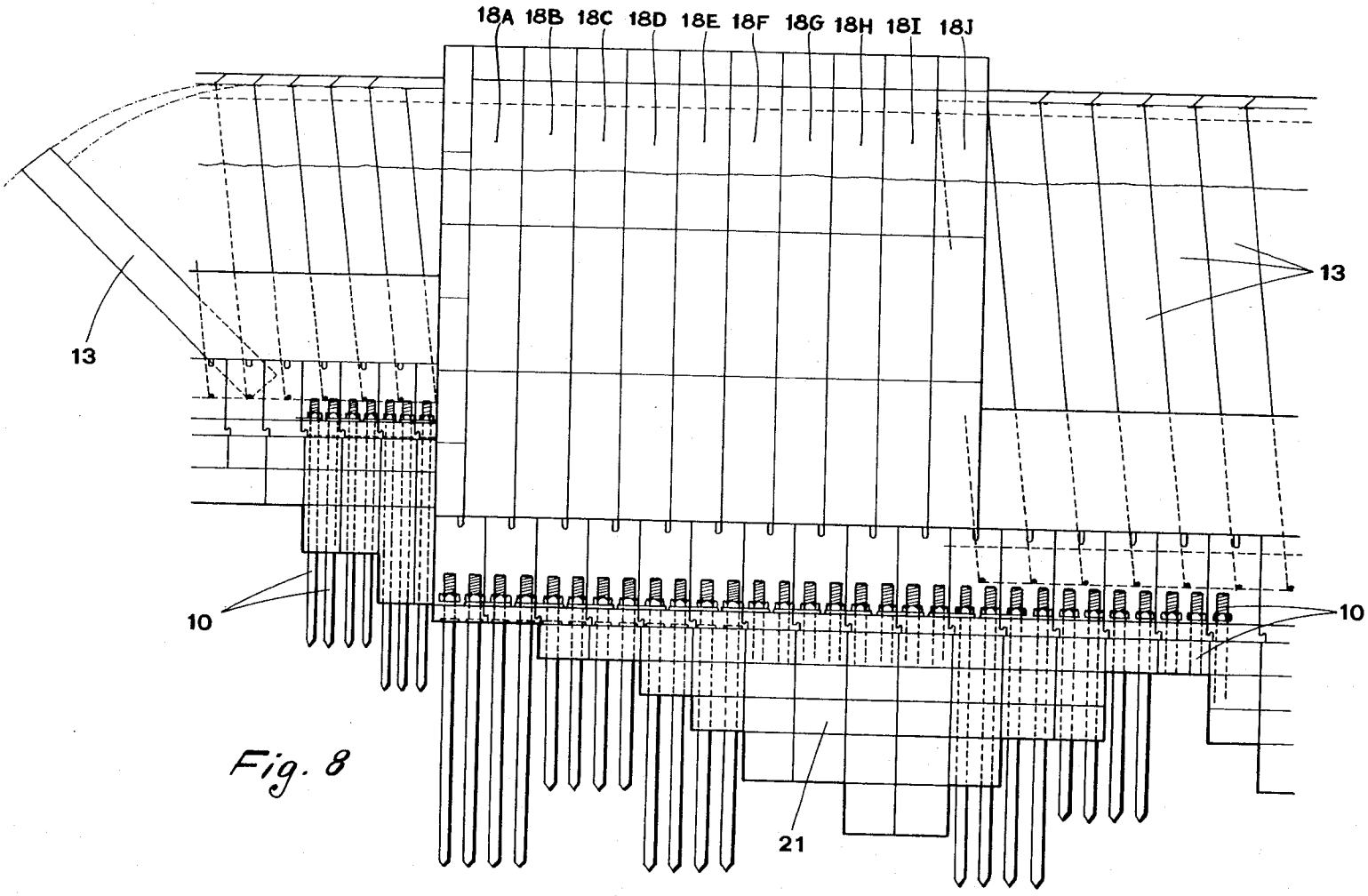

FIG. 8, showing a side elevation, schematic, of the control cabin.

Figure 9:
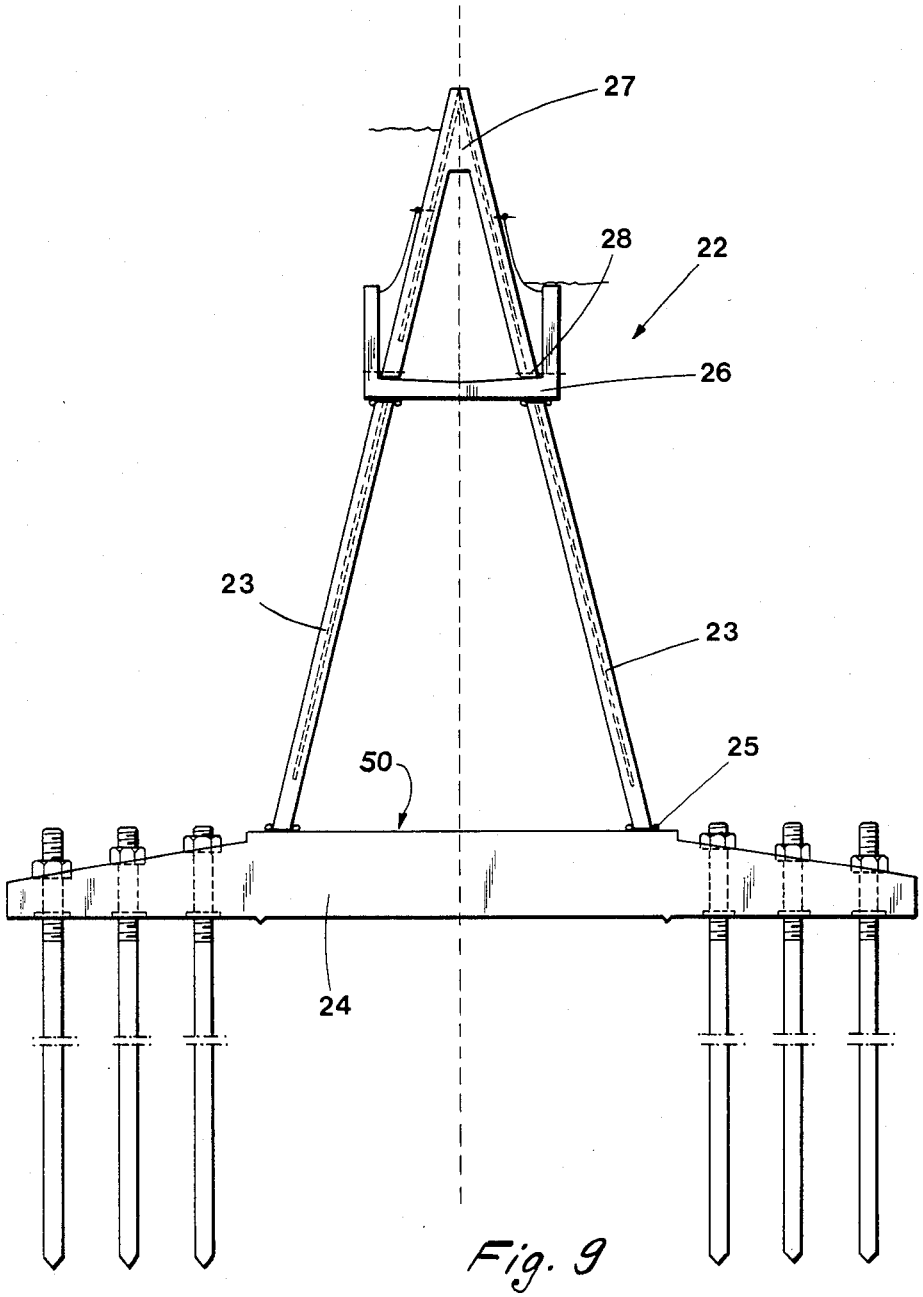

FIG. 9, showing a schematic cross-section of the dam with partially mobile elements in their raised position.

Figure 10:
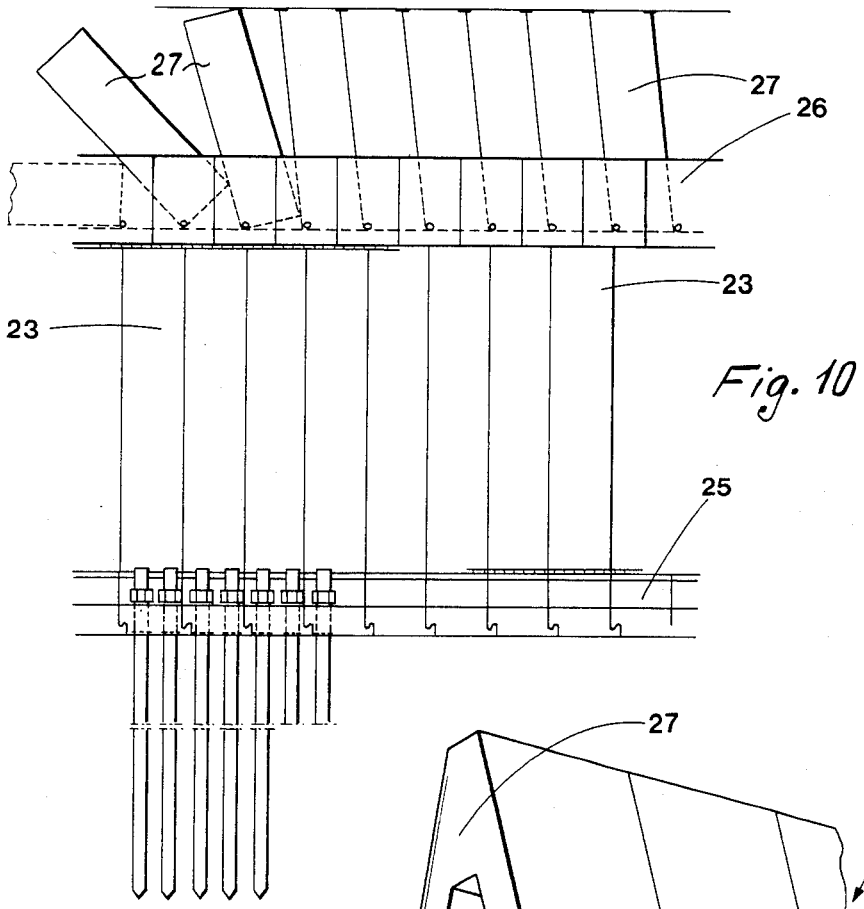

FIG. 10, showing a front elevation of the dam with mobile elements in their lowering cycle.

Figure 11:
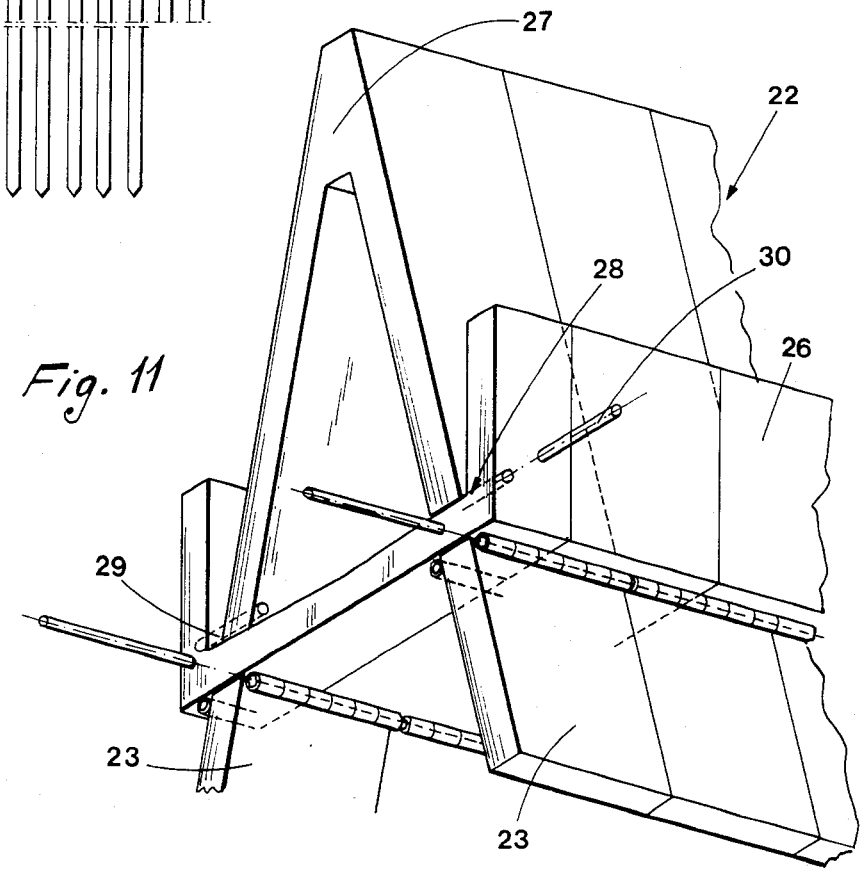

FIG. 11, showing a schematic perspective view bringing in evidence hinge elements for both fixed elements and mobile elements.

Figure 12:
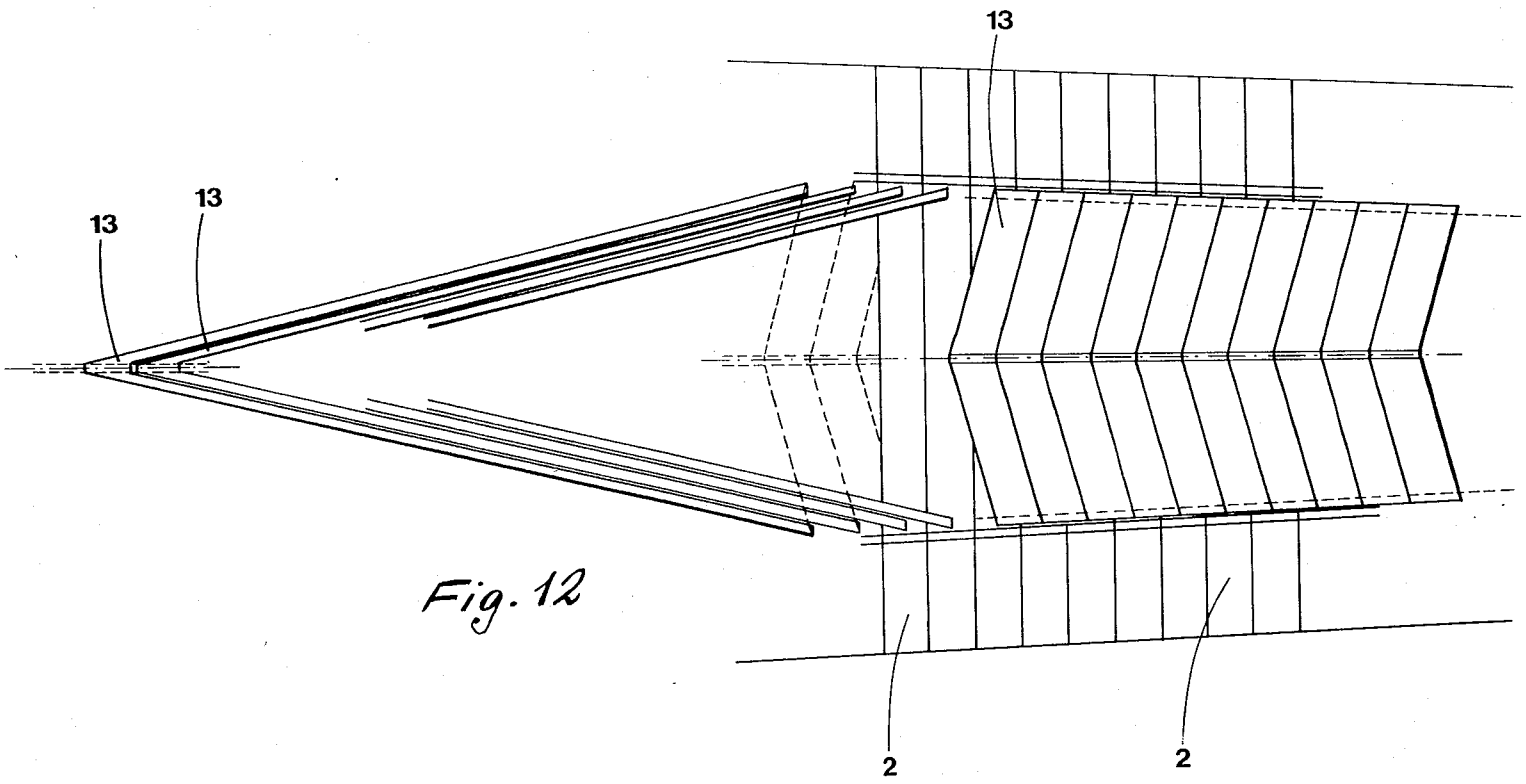

FIG. 12, showing a schematic view from above of mobile elements positioned at constant, varied inclinations.

Figure 13:
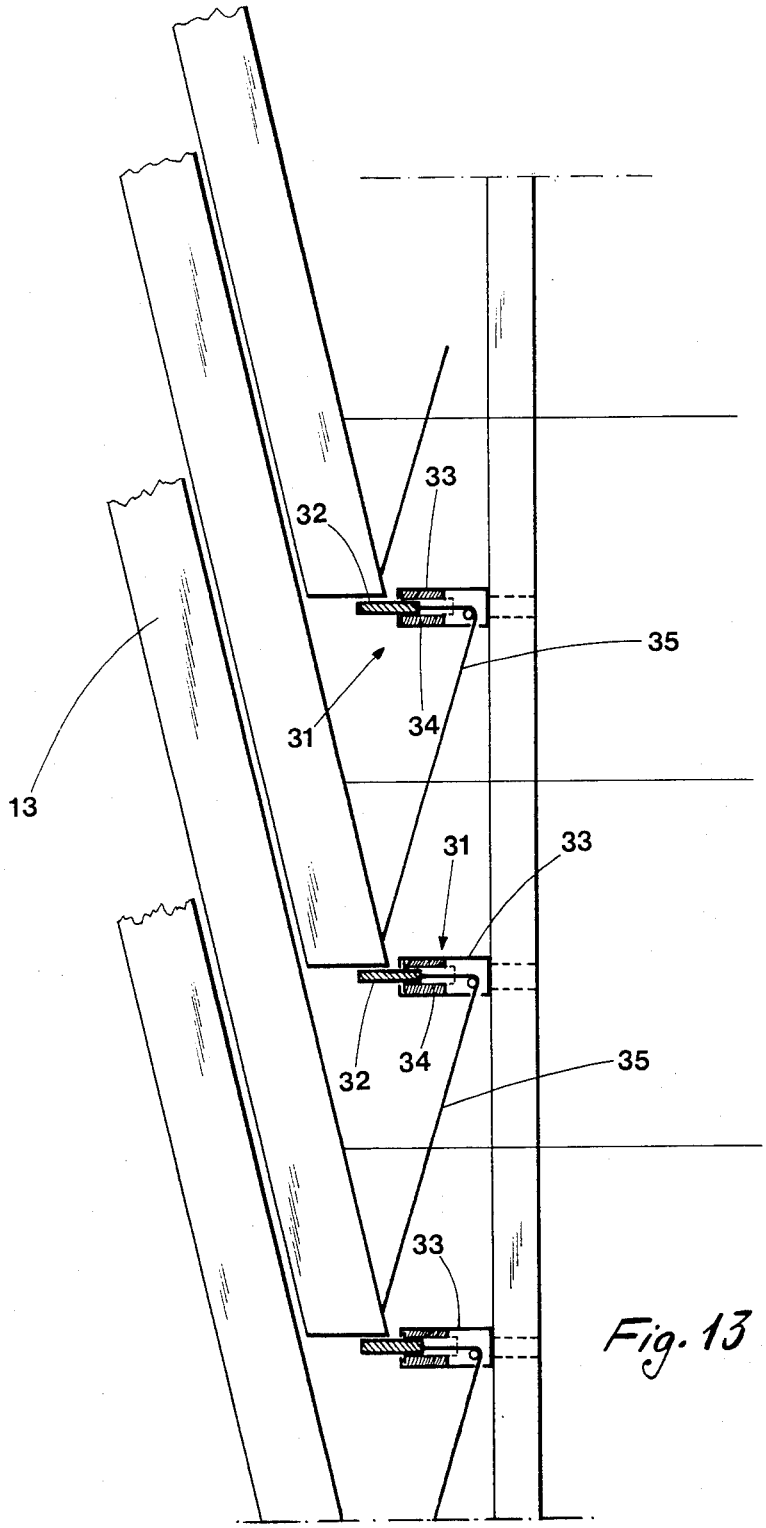

FIG. 13, showing a schematic view of a mechansism designed to hold the mobile elements closed.

With reference to the enclosed drawings, number 1 refers to a first embodiment of a dam with mobile (movable) water-retaining elements. This dam consists basically of foundation plinths 2, made preferably out of reinforced concrete, with, on their top sections, lateral shoulders 3 and 4, which define a channel 40 and positioning profiles 5 on their bottoms. Cross pins 6 and 7 are inserted into these lateral shoulders 3 and 4, and extend out to both the inside and the outside sections of the shoulders, as do cleaning components indicated, respectively, with the numbers 8 and 9. The cleaning components are designed to keep the bottom of the plinth, where the mobile panels are housed once they are lowered, clean and free from impediments.

On their sides these plinths carry a series of holes 17 designed for carrying means for anchoring the plinths themselves to the sea or river bottom. Anchoring means consist of piles 10, equipped with heads with levelling screw 11 and nut 12. In the upper section of plinths 2, and specifically in the section included between lateral shoulders 3 and 4, we find the zone where mobile water-damming elements 13 are inserted.

Elements 13 consist of a series of structures with a basically overturned VEE shape. These join with the foundation plinths through the inner section of pins 6 and 7, inserted in slots 14 and 15 which are built into the mobile components.

Elements 13 are situtuated one following the other, in order to create, once raised, a barrier, and are at the same time designed so that, once they are lowered, they enter consecutively one into another, coming to rest on the section between shoulders 3 and 4 of foundation plinth 2. Z Elements 13 are made of a material such as prestressed concrete, or metal, or any other material suitable for these purposes, and can be hollow inside so that if they are filled with air, or with any other material lighter than water, they will be lightened themselves, due to hydrostatic thrust, in a way that almost totally counterbalances the weight of their structure, and thus permit them to be maneuvered using simple mechanisms.

These mechanisms, in the example now being discussed, consist of cables 16, driven by a motor system, but can, in practice, consist of hydraulic pistons or other systems, controlled from control cabins 18A through 18J as explained further on.

Cables 16 can pass either through slots, or similar openings, positioned in the lower section of shoulders 3 and 4, or in slots, or similar openings 20, placed below the outside lateral surface of elements 13. Levelling masses 21 are also provided for, also made of prefabricated reinforced concrete, able to create a support surface for the foundation plinths if the sea or river bottom is extremely uneven (where there are shipping channels, for example). These masses have a structure with guide slots and joints permitting precision alignment with the foundation plinths. Masses 21 are also anchored to the sea or river bottom using piles 10. Cabins 18A through 18J are made using the same foundation and sea or river bottom anchoring means as were used for the dam with mobile components. Cabins 18A through 18J are especially useful because they house the equipment controlling opening and closing of the mobile dam, and if installed where the sea or river bottom changes depth, can serve to connect different height mobile elements 13.

Once installation is completed the mobile dam, when closed, is below the sea bottom, as illustrated in FIG. 2, whereas when it is in its raised or damming position, it is as illustrated in FIG. 1.

The panels, once they are lifted, fit together as shown in FIG. 6, creating a barrier with a perfect water seal.

The shape of the structure guarantees seal even in the presence of strong sea pressures, by simply adapting the dimensions of foundation and mobile elements to the situation. In addition the speed and simplicity with which the mobile elements of the dam can be lifted or lowered guarantees an effective system protecting against high tides, such as those that occur at Venice, where there is only a brief period of warning prior to occurance of the phenomenon itself.

In another example of embodiment, necessary to obtain basins such as, for example, ship transit locks, the dam, indicated in its entirety by number 22, shows partially mobile water-retaining elements. This dam consists of fixed components 23, resting on the bottom on foundation plinths 24, and joined to these by hinge assemblies 25 which define channel 50. Fixed components 23 have an acute angle inclination, and are secured at the top, using hinge assemblies, to reinforced member 26, which has a basically U cross-section, and is designed to contain mobile components 27 once these are reclined. Mobile components 27 are positioned on the top surface of this reinforced member, have a basically overturned VEE shape, and constitute an extension of fixed elements 23. These mobile components are hinged to this top surface by hinge assemblies 28. More specifically, these mobile components have, in their lower section, mechanisms 29 where swivelling pins 30 are inserted. As necessary the mobile components of the dam can be lowered, using opportune means, such as cables, hydraulic devices or the like, in order to permit the flow of water to enter or exit the basin or channel, and in this way creating the desired water-retention effect.

In another example of embodiment, where the sea bottom has a constantly changing variable depth, the dam consists of mobile components of varying heights. The number of components remains the same, following an opportune modular system, and the dam presents, when it is in its water-retention position, a top edge line that is at a constant distance from the upper surface line of the water. The mobile components in this example, as shown in FIG. 12, are arranged in a scaled manner, so that each larger element is able to contain the following, smaller, element.

A further advantage is that mobile components 13 and 27 can contain, near their tops, openings with floodgates, which can be maneuvered using systems such as steel cables, ropes, or the like. This permits, especially with basins, the flow of water into or out from the basin to be regulated as necessary. Mechanisms 31 are present to hold mobile components 13 and 27 in their closed position. These mechanisms consist of small pistons 32 sliding inside cylinders 33, for a certain length constrasting spring 34, and controlled by cables 35. These mechanisms are secured to the dam's fixed structure and are positioned (see FIG. 13) so that each component 13 and/or 27 , at the end of its opening travel, frees the component that follows, activating cable 35 which releases the clamp on the component, still in its closed position.

I claim:

1. A system for creating dams comprising:

a series of foundation plinths arranged parallel to one another, each plinth having a first shoulder and a second shoulder which define a channel between the shoulders, the plinths being adapted for placement below a bottom of a body of water with only a portion of the first and second shoulders extending into the body of water and with substantially the entire channel disposed below the bottom;

a series of movable water-retaining elements pivotally secured to the plinths so as to pivot from a first substantially upright position to a second substantially horizontal position, the elements having a cross section shaped in the form of an inverted V when viewed in the first position along the channel in a direction perpendicular to a length of the plinths, the elements being arranged so that in the first position a substantially water tight seal is formed between the elements and so that in the second position the elements are disposed substantially within the channel with the elements being nested within an adjacent element, and;

means for moving the movable elements from the first position to the second position.

2. A system according to claim 1 further comprising anchor piles, each anchor pile extending through a hole in a one of said plinths, each anchor pile having means for adjusting a distance of extension of the anchor pile from the plinth.

3. A system according to claim 1 further comprising levelling masses for being positioned below said plinths, and means for aligning said levelling masses with said plinths.

4. A system according to claim 1 in which at least one of the foundation plinths and levelling masses have shapes permitting them to interconnect.

5. A system according to claim 1 in which the movable elements are of different heights and are arranged so that a larger movable element can contain a smaller movable element.

6. A system according to claim 1 further comprising means for retaining the movable elements in the first position.

7. A system for creating dams comprising:

a series of foundation plinths arranged parallel to one another, each plinth having a first shoulder and a second shoulder which define a first channel between the shoulders;

a first series of fixed water retaining elements secured to the first shoulders and a second series of fixed water retaining elements secured to the second shoulders, the first and second series of fixed water retaining elements being secured to the shoulders so as to extend upwardly and to incline toward one another;

a channel shaped reinforcing member secured to the tops of the first and second series of fixed water retaining members, the channel shaped member having substantially vertically extending walls defining a second channel between the walls;

a series of movable water retaining members pivotally secured to the walls so as to pivot from a first substantially upright position to a second substantially horizontal position, the elements having a cross section shaped in the form of an inverted V when viewed when in the first position, along the second channel in a direction perpendicular to a length of the plinths, the elements being arranged so that in the first position a substantially water tight seal is formed between the elements and so that in the second position the elements are disposed substantially within the second channel with the elements being nested within an adjacent element; and means for moving the movable elements from the first position to the second position.

8. A system according to claim 7 in which the movable elements are of different heights and are arranged so that a larger movable element can contain a smaller movable element.

9. A system according to claim 1 further comprising means for retaining the movable elements in the first position.

* * * * *